US011801983B2

(12) United States Patent
Tallman

(10) Patent No.: US 11,801,983 B2
(45) Date of Patent: Oct. 31, 2023

(54) REUSEABLE BOTTLE CARRIER WITH COVER AND HANDLE, MADE OF SILICONE MATERIAL

(71) Applicant: Derick M. Tallman, Ankeny, IA (US)

(72) Inventor: Derick M. Tallman, Ankeny, IA (US)

( * ) Notice: Subject to any disclaimer, the term of this patent is extended or adjusted under 35 U.S.C. 154(b) by 381 days.

(21) Appl. No.: 17/004,285

(22) Filed: Aug. 27, 2020

(65) Prior Publication Data

US 2022/0063886 A1 Mar. 3, 2022

(51) Int. Cl.
*B65D 71/00* (2006.01)
*B65D 71/52* (2006.01)

(52) U.S. Cl.
CPC ..... *B65D 71/0003* (2013.01); *B65D 2571/00333* (2013.01); *B65D 2571/00432* (2013.01)

(58) Field of Classification Search
CPC ..... B65D 71/0029; B65D 71/0022; B65D 71/0077; B65D 71/0003; B65D 71/0014
USPC ..... 206/168, 162, 203
See application file for complete search history.

(56) References Cited

U.S. PATENT DOCUMENTS 3,814,238 A 6/1974 Wood
3,834,750 A 9/1974 Gauntlett
3,842,976 A * 10/1974 Dea ..... B65D 1/24 206/811
4,040,517 A * 8/1977 Torokvei ..... B65D 1/243 220/519
5,474,172 A 12/1995 Zavatone et al.
5,765,684 A * 6/1998 Van Dore ..... B65D 25/108 206/427
6,651,836 B1 * 11/2003 Hofheins ..... A47G 19/06 220/737
9,718,592 B1 * 8/2017 Scanlan ..... B65D 71/0003
9,861,169 B1 * 1/2018 Scior ..... A45C 9/00
10,053,270 B2 8/2018 Eckermann
2008/0116085 A1 * 5/2008 Artis ..... B65D 5/48036 206/139
2017/0105324 P1 * 4/2017 Bourne ..... Plt./207

OTHER PUBLICATIONS

Uline 6 Bottle Beer Carrier—https://www.uline.com/Product/Detail/S-19907/Wine-Shippers-and-Supplies/6-Bottle -. . . Screenshot downloaded on Aug. 26, 2020.

(Continued)

*Primary Examiner* — Steven A. Reynolds

(57) ABSTRACT

A re-useable, washable two-piece four and six bottle carrier comprising a base with partitions to store one beverage per partition, and a detachable cover. The base comprises four vertical outer walls and a middle handle extending vertically through a cover slit; and is made of a re-useable silicone material manufactured from a one-piece mold. The detachable slip-on cover comprises a plurality of circular openings aligned with the base partitions for inserting a beverage, each opening comprising a plurality of radially concavity flexible grips that may bend downward at about 45 degrees after insertion of a beverage into the opening. These flexible grips permit beverages of different sizes and weights to be used in the carrier while being held in position. Method of use comprises attaching the cover to the base with the base handle extending through the cover, then inserting and removing the beverages through the cover openings.

14 Claims, 7 Drawing Sheets

(56) References Cited

OTHER PUBLICATIONS

Etsy 6 6 pack article carrier—https://www.etsy.com/listing/757819995/new-baby-dad-gift-6-pack-of-dribble. Screenshot downloaded on Aug. 26, 2020.
Juvale Neoprene Insulated 6-pack Baby Bottle Carrier Tote Bag: https://www.amazon.com/Juvale-Neoprene-Insulated-6-Pack-Carrier/dp/B07KF3JYW3/ref . . . Screenshot downloaded on Aug. 26, 2020.
Home Mixology Bottle Carrier: https://www.target.com/p/home-mixology-bottle-carrier/-/A-53694326?winst=1598508832408&of=0. Screenshot downloaded on Aug. 26, 2020.

* cited by examiner

REUSEABLE BOTTLE CARRIER WITH COVER AND HANDLE, MADE OF SILICONE MATERIAL

FIELD OF THE INVENTION

The present invention relates to a re-useable, machine washable bottle carrier; and in particular, to a system, method and apparatus with a handle for transporting multiple beverage containers in one durable carrier, which contains: partitioned off sections in the carrier; a detachable rubberlike cover; and top openings in the cover with a plurality of radially concavity flexible grips for securing the bottles within the carrier.

BACKGROUND OF THE INVENTION

In general, most carriers have been made out of paperboard type material with multiple pieces coming together and/or paperboard that must be folded and come together, sometimes by using glue, rather than a one-piece molded design. Such bottle carriers have been collapsible for storage due to the thinner paperboard material and design; and are cost-effective effective since they can be produced from a one-piece blank with relatively low material use. However, it has been shown that such paperboard bottle carriers can fail under high loads and are not as long-lasting and durable as a plastic, metal, or rubberlike bottle carriers. Against this background, an object of the invention is to create a bottle carrier that is made out of a stronger material than paperboard and is thus longer lasting.

What is needed within the art is a sturdy, durable (re-useable), easily manufactured bottle carrier with a mechanism to secure or lock the bottles within the carrier.

SUMMARY OF THE INVENTION

The present invention is based on the conclusion that, in conventional bottle carriers, the method of production and therefore durability of the carrier, is insufficient. In conventional bottle carriers, they are assembled by paperboard or a similar material where the carrier is cutout and folded or glued for strength and may include an insert that is attached and/or glued to the carrier. According to the invention, this defect can be corrected by using a mold to produce the one-piece bottle carrier, where a slip-on cover is added to allow for multiple sized bottles to be utilized by the carrier. The slip-on detachable cover contains openings based on the location and number of openings available in the carrier. The openings in the cover are surrounded by a plurality of radially concavity flexible grips to allow placement of different shapes and sizes of bottles to be used by the carrier.

More particularly, the invention relates to a bottle carrier made out of flexible material that contains a slip-on cover with holes that are surrounded by flexible grips to allow different sized bottles to be used for the carrier.

The slip-on cover delimits an opening surrounded by a plurality of radially concavity flexible grips above each opening from the carrier. In an embodiment with wide diameter bottles, each of the radially concavity flexible grips are bent downward at about 45-90 degrees after insertion of a bottle into a respective opening, whereby the radially concavity flexible grips permit bottles of different sizes to be used in the carrier and facilitate a hold on the bottles and allow for guided removal. In another embodiment with thinner bottles, the flexible grips are strong enough to hold the bottle in position and thus not bend inward if the bottle is jostled during transport. The detachable slip-on cover contains a gap to slide over the handle of the bottle carrier.

An object of the present invention is to provide a bottle carrier that is re-useable, machine washable, and durable.

Another object is to provide a bottle carrier that is able to lock the bottles in place to prevent them from falling out of the carrier during transport.

Another object is to provide a bottle carrier with four partitions able to stably transport one to four bottles (4-bottle) of the same or of a different type, size, and weight.

Another object is to provide a bottle carrier with six partitions able to stably transport one to six bottles (6-bottle) of the same or of a different type, size, and weight. In an embodiment, the present invention comprises a beverage carrier with a substantially square or rectangular shaped base and a detachable cover. The base comprises a horizontal flat bottom connected to a vertical sidewall, comprising a front, back, right and left seamless sidewall, to form a substantially square or rectangular shaped container able to hold a plurality of beverages. The base further comprises: at least one vertical partition extending perpendicularly between the front to the back vertical sidewalls; a base handle extending from the flat bottom through the cover, and positioned in the middle of the right and left vertical sidewall; and a plurality of substantially rectangular shaped cavities able to hold one beverage container per cavity, wherein the cavities are created by the vertical partitions, the handle, and the vertical sidewalls.

The detachable cover comprises: a horizontal flat sheet with a plurality of substantially circular cutouts, each cutout aligned with a base cavity and able to grip and secure a drink container; a side wall extending vertically downward from the horizontal flat sheet, and able to secure the detachable cover to the base; and a horizontal slit for inserting the base handle;

The foregoing description and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments and cover are attained can be undertook in more detail, a more particular description may be had by reference to the embodiments thereof that are illustrated in the appended drawings. However, the drawings illustrate only some embodiments and therefore are not to be considered limiting in scope as there may be other equally effective embodiments.

FIGS. 9A and 9B demonstrate a carrier with the detachable cover off and the beverage containers are still stable.

FIGS. 9C and 9D demonstrate beverage containers housed in the carrier with the cover on and the cover grips pushing the sides of the beverages to keep them upright.

DETAILED DESCRIPTION OF THE INVENTION

While this invention may be embodied in many different forms, there are described in detail herein one or more exemplary embodiments of the invention. This description is an exemplification of the principles of the invention and is not intended to limit the invention to the particular embodiment illustrated. Various exemplary embodiments of a 4-bottle carrier are illustrated herein, with the understanding that a 6-bottle carrier is envisioned within the scope of the invention.

As used herein, the term "bottle" and "beverage" are used interchangeable and refers to various types of drinking containers that are able to fit in the 4-bottle and 6-bottle carriers disclosed herein. A carrier 10 may be customized to a size to securely fit a specific type of bottle (e.g. a baby bottle).

Figure 1:
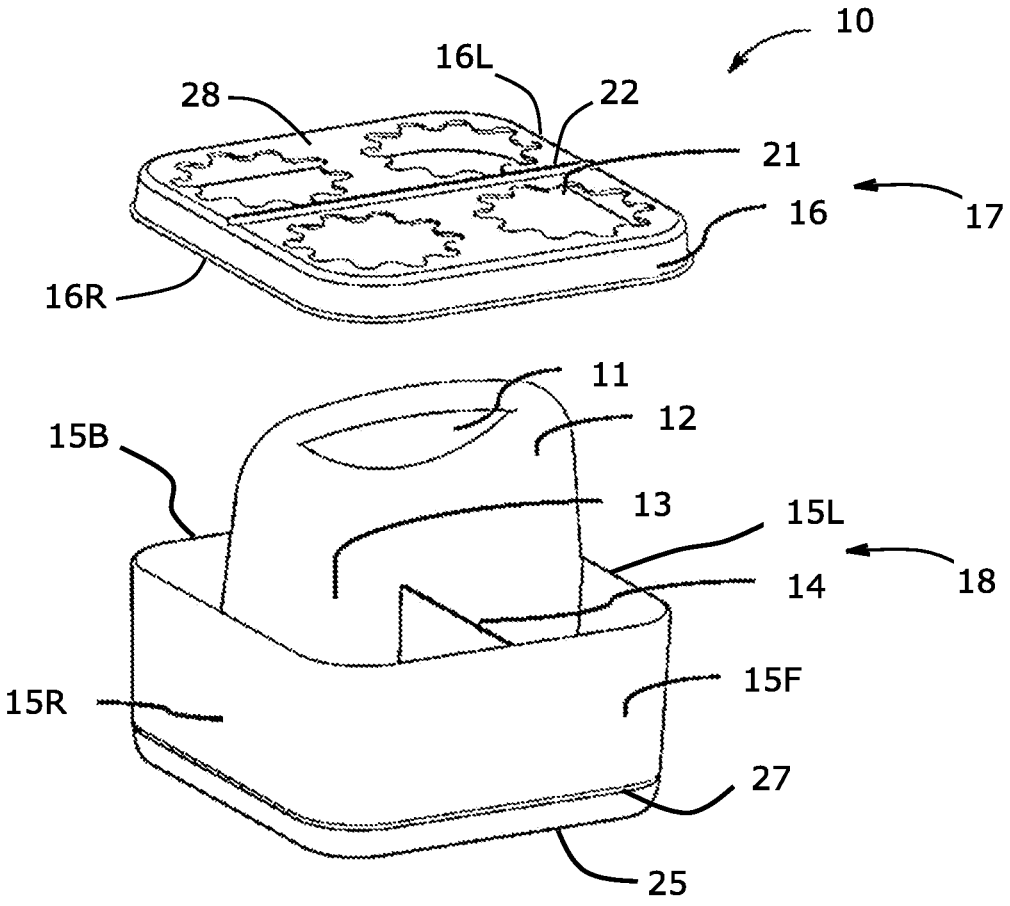
FIG. 1 is a top perspective view of the detachable cover and bottle carrier with a handle.
Figure 2:
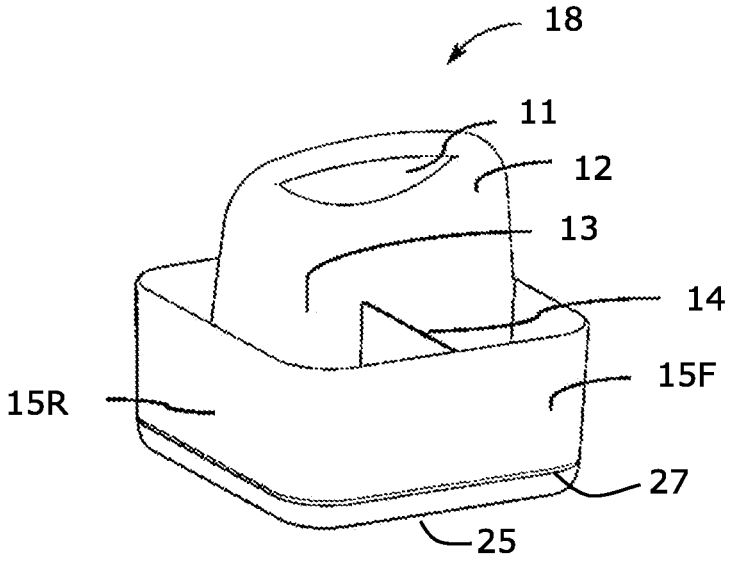
FIG. 2 is a perspective view of the bottle carrier without the detachable cover.

In the figures, the use of the same reference symbols in different drawings indicates similar or identical items. As shown in FIG. 1, all embodiments of a re-useable bottle carrier 10 of the present invention comprises a one-piece base 18 able to hold the beverages, and a detachable cover 17.

Base

Base 18 comprises: a flat bottom 25 connected to the front 15F and rear 15B vertical sidewall, and the right 15R and the left 15L sidewall. The sidewall 15 comprises no vertical seams joining 15R, 15F, 15L, 15B, and are substantially vertical sidewalls (i.e. are about 92 degrees). Base 18 is thus formed as one unit with curved ends joining the sidewalls. The points of joining flat bottom 25 and sidewall 15 is also seamless and may further comprise a thin rib of cosmetic material 27 positioned horizontally on the outer sidewalls.

A base handle 12 extends vertically upward from the flat bottom 25 to above the carrier 10. Handle 12 extends from the middle of the right sidewall 15R to the middle of the left sidewall 15L. Handle 12 further comprises on the top end a cutout 11 that is sufficiently large enough to allow an adult hand to insert, grab, lift, and transport the carrier 10.

The base 18 further comprises an interior compartment with partitioned off sections, cavities, etc. 13 (e.g. one cavity 13 per beverage container or bottle). In the 4-bottle embodiment, the partitions are created by one vertical wall 14 that extends from the middle of the front sidewall 15F to the middle of the back sidewall 15B. Partition or wall 14 intersects perpendicularly with the vertical handle 12, thus creating four equally sized cavities 13 that are substantially square or rectangular shaped to store normally a round beverage container.

In the 6-bottle embodiment, the cavities are created by two equally spaced vertical walls or partitions 14 that extends from the front sidewall 15F to the back sidewall 15B. The two partitions 14 intersects perpendicularly with the vertical handle 12, thus creating six equal sized cavities 13.

Detachable Cover

The carrier 10 cover 17 is detachable from the base 18. Cover 17 comprises: a top flat sheet 28 with a plurality of circular openings or apertures 21. Each opening 21 is able to grip or press against and secure a drink container within the base 18 so that it does not fall out, jostle, or otherwise spill while in transport.

Figure 3:
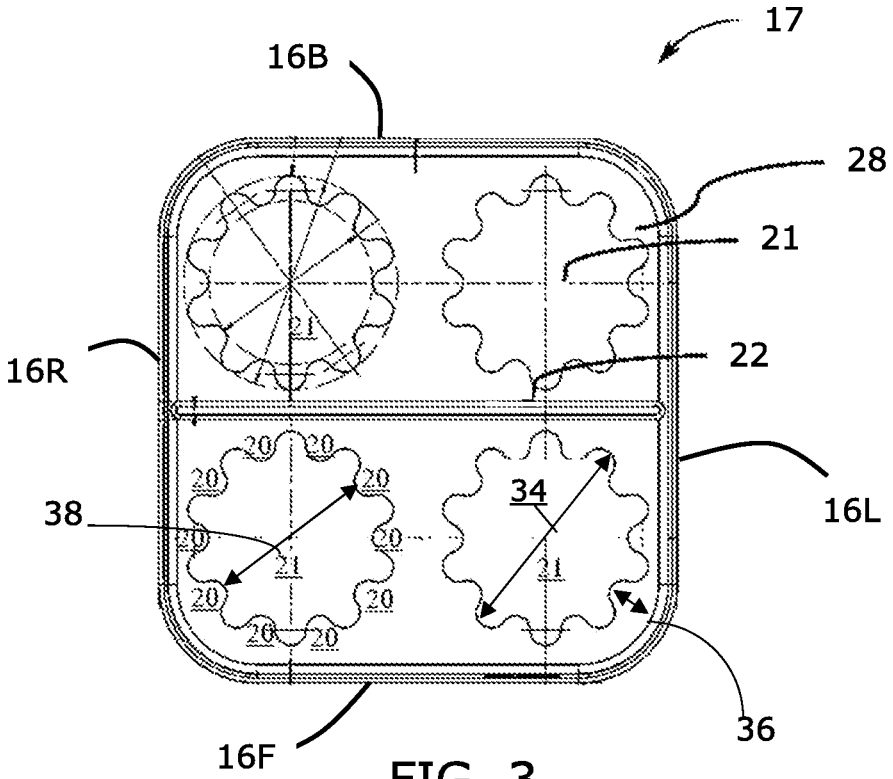
FIG. 3 is a top plan view of an exemplary detachable cover depicting flexible grips in the cover for stabilizing the bottles inserted into the carrier.
Figure 4:
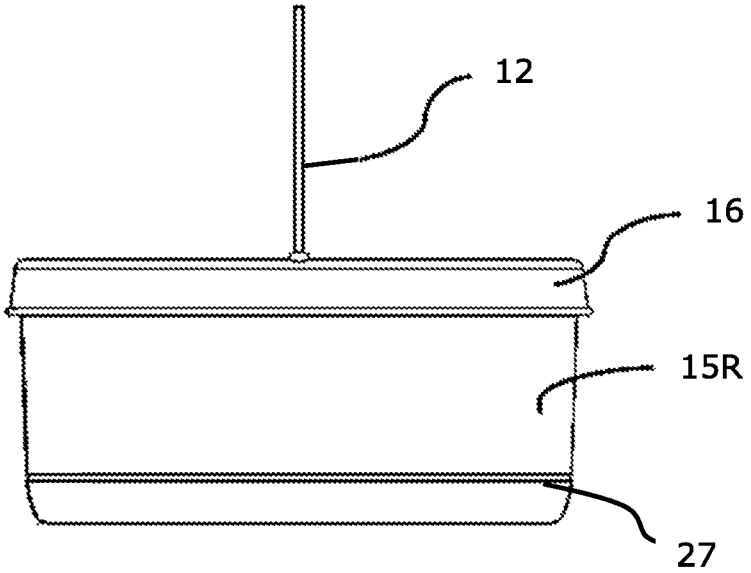
FIG. 4 is a right-side view of the bottle carrier.

As illustrated in FIG. 3 for a 4-bottle carrier, the openings 21 in the cover 17 are aligned over the top of each partitioned off section 13, and each opening 21 is surrounded by a plurality of radially concavity flexible grips 20 to allow placement of different shapes and sizes of bottles to be used by the carrier 10. The plurality of radially concavity flexible grips 20 are made of flexible material that is able to be pushed downward at about 45 degrees when a bottle or drink container is inserted in through an opening 21 in the top of the cover 17 of the carrier, if the object is large enough in diameter. The flexible grips 20 facilitate a hold on the object in the carrier and allow for the embodiment to receive and engage an object to restrict movement of an object while inserted in the embodiment; and the flexible grips 20 also allow for guided removal of the object. In an embodiment, the objects are inserted into the carrier 10 after the cover 17 is affixed to the base 18.

Figure 11:
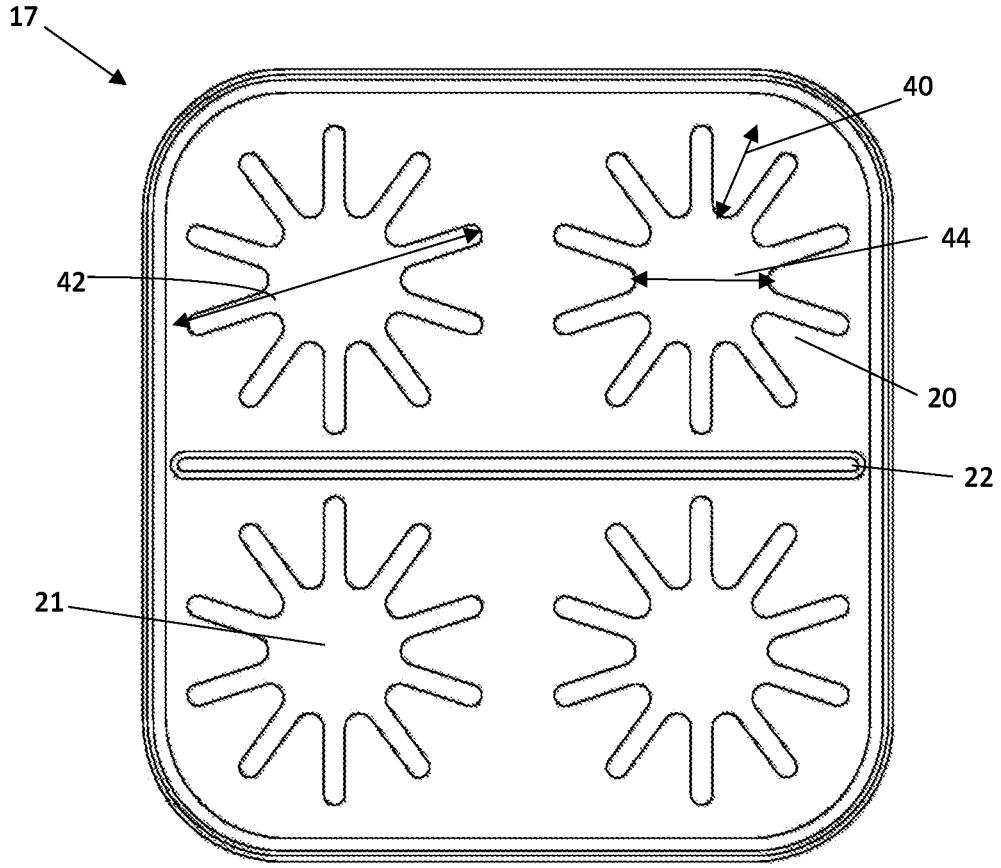
FIG. 11 is a top plan view showing another embodiment of the cover openings with pointed grips.

As illustrated in FIGS. 3 and 11, grips 20 and circular openings or apertures 21 may come in a variety of sizes, depending upon the type of beverage to be transported in carrier 10. For example, as shown in FIG. 3, grips 20 may be substantially round ended with a length 36 of about 0.25 inches, or as illustrated in FIG. 11 grips 20 are more pointed with a length 40 of about 0.80 inches. Likewise, while the diameter or length 34, 42 of the circular openings 21 may be from about 2.5 inches to about 3 inches (e.g. the maximum diameter of the bottom of a beverage container 32), the inner aperture diameter 38, 44 may vary depending upon the shape and length of grips 20, e.g. about 0.9 inches to about 2.0 inches. In a particular embodiment, as illustrated in FIG. 11, grips 20 are 0.80 inches in length 40, circular opening-aperture 21 has a diameter 42 of 3.0 inches, and the inner aperture 44 is about 1.4 inches in diameter.

Figure 5:
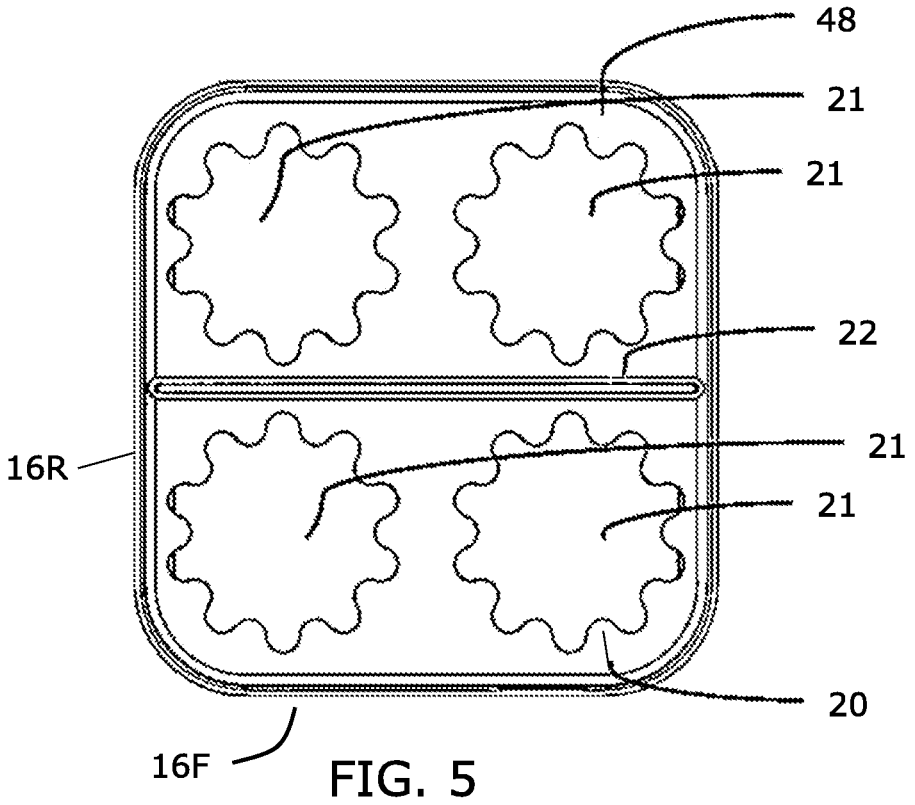
FIG. 5 is a top plan view of an exemplary bottle carrier with the cover attached and the handle extending vertically upward through the cover.
Figure 6:
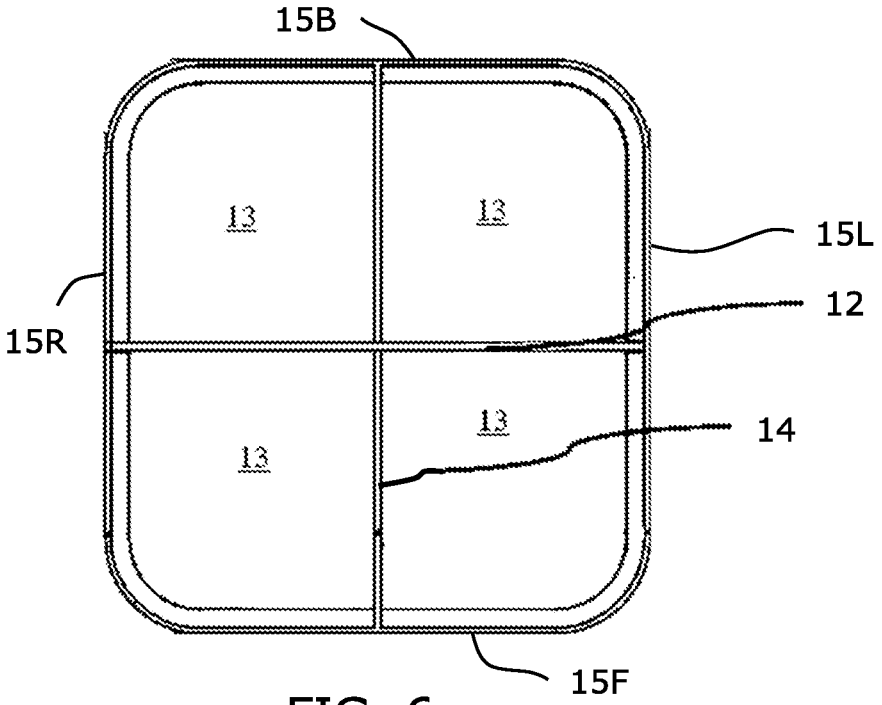
FIG. 6 is a top plan view of an example embodiment of the carrier without a detachable cover demonstrating four substantially square bottomed partitions.
Figure 7:
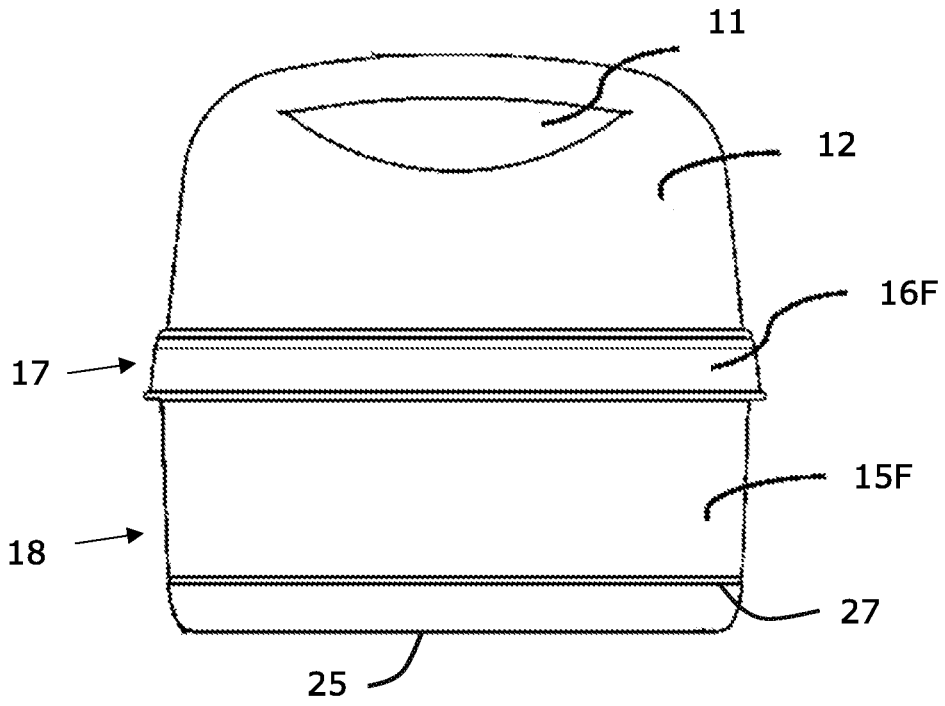
FIG. 7 is a front elevational view of an exemplary bottle carrier with the cover attached.

Cover 17 further comprises a sidewall 16R, 16L, 16B, 16F extending vertically downward from the flat sheet's entire periphery. In an embodiment, sidewall 16 is about 22 millimeters in width. Sidewall 16 further comprises a resilient material (e.g. rubber and/or silicone ribs) and/or inner threads (e.g. FIG. 5, 48) and/or inner hooks/fixtures that enable cover 17 to stay securely fixed to the base sidewalls 15.

Figure 8:
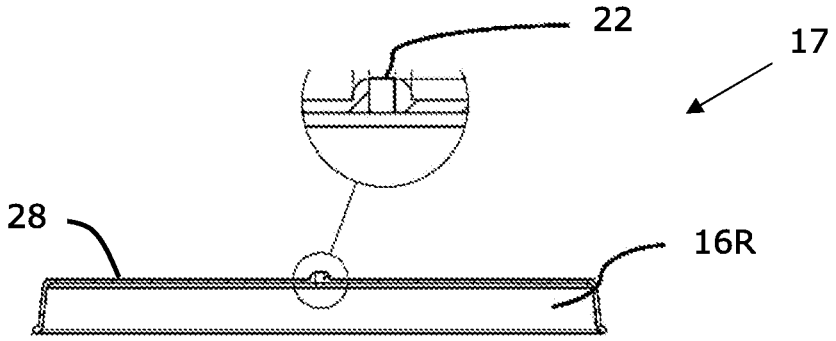
FIG. 8 is a side view of an exemplary cover depicting the middle gap where the bottle carrier's handle slides into and up through the cover.

Cover slit 22 extends across the middle of the cover 17 to enable the base handle 12 to extend vertically upward through the cover. In an embodiment as shown in FIGS. 1 and 3, slit 22 extends between the cover's right side 16R and left side 16L in alignment with the base handle 12. FIG. 8 is an expanded view of slit 22.

Dimensions

Table 1 provides an exemplary embodiment of a 4-bottle carrier dimensions.

TABLE 1

| |
|---|
| Cover 17: 7.63 inches (194 mm) × 8 inches (204 mm) |
| Grips 20: .25 inches to .80 inches in length. |
| Circular aperture/openings 21: 2.5 inches to 3.0 inches |
| Inner Aperture Diameter 30 between grips: 2.5 inches to 1.4 inches in diameter |
| Base 18: 7.24 inches (184 mm) × 7.63 inches (194 mm) × 7 inches (180 mm) w/handle, 3.54 inches (90 mm) without handle |
| Handle 12: 7.24 inches (184 mm) × 0.12 inches (3 mm) × 3.54 inches (90 mm)-handle hole is: 3.5 inches (89 mm) × 0.875 inches (22 mm) |

Figure 10:
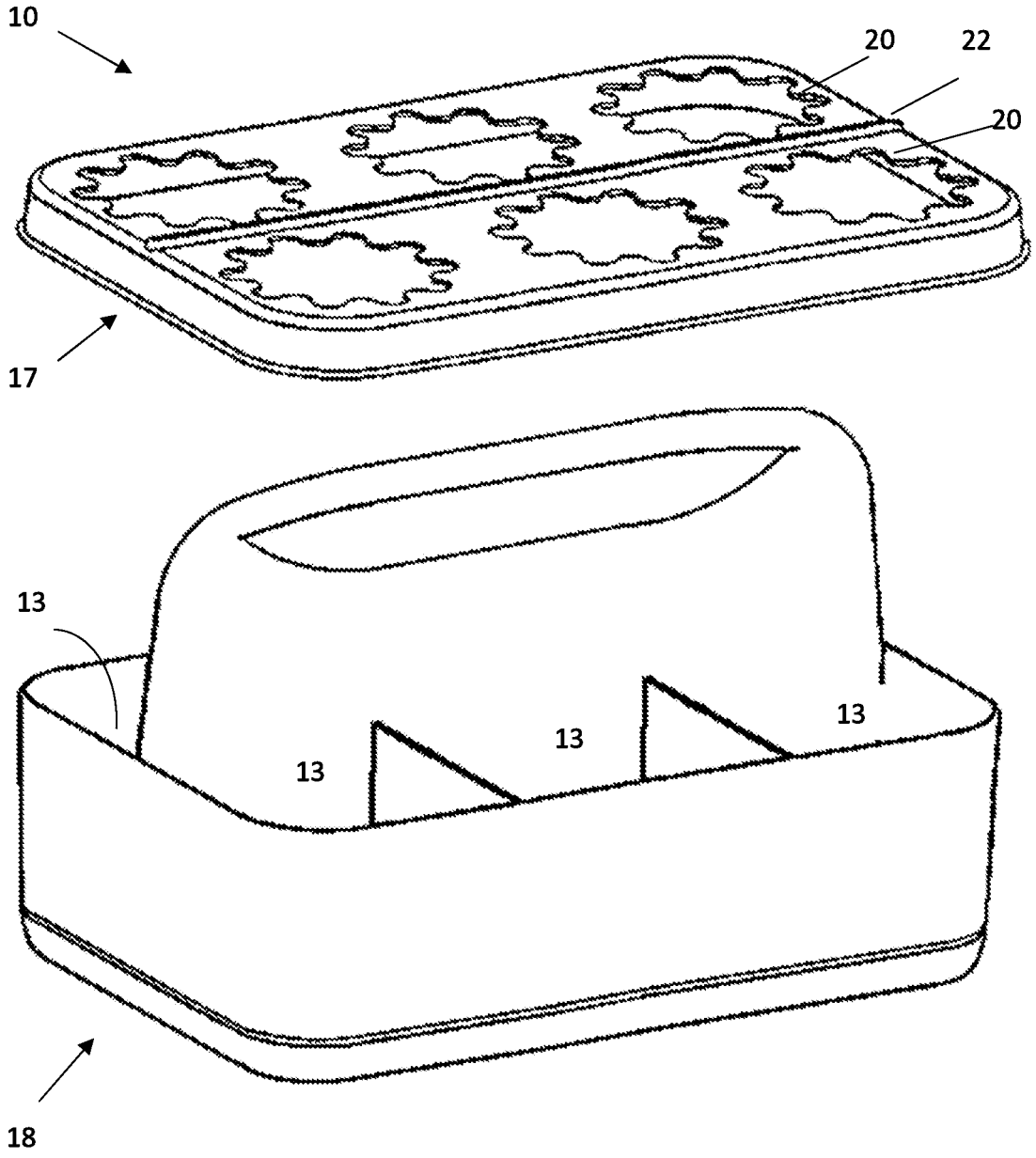
FIG. 10 is an exemplification of another bottle carrier with six partitions able to carry a total of six bottles.

As illustrated in FIG. 10, a 6-bottle carrier comprises: cavity 13 dimensions (i.e. width, height) that are similar dimensions to the 4-bottle carrier's, thus making the 6-bottle carrier approximately one-third larger, and able to carry the same size beverages as the 4-bottle carrier.

In another embodiment, the 6-bottle carrier outer dimensions are the same as the 4-bottle carrier's, thus making the cavities 13 about one-third smaller than the 4-bottle carrier's, so that the 6-bottle carrier stores smaller beverages than the 4-bottle carrier's (e.g. mini-bottles).

Hence, the scope of the present invention comprises 4 and 6 bottle carriers of different dimensions than listed herein, and the carrier size may be a function of the type of bottle the carriers are intended to be used in (e.g. baby bottles).

Types of Beverage Containers

As illustrated in FIGS. 9A-9D, various types of beverage containers 32 are able to be used with the carrier 10. By way of non-limiting examples, beverage containers comprise: thin neck glass bottles (e.g. Perrier®, Coke®, etc.), plastic reuse-able bottles (e.g. sports drinks, personal water bottles with and without handles), paper cups and plastic cups with wide circular rims (e.g. Starbuck's® paper), and plastic and silicone baby bottles, etc. In an embodiment, carrier 10 is able to securely transport a plurality of plastic (baby) bottles with diameters of about 1.75 inches to 3.5 about wide. For example, a bottle with a bottom diameter up to 3 inches fits into cavity 13 through lid 17 opening or aperture 21.

Figure 9A:
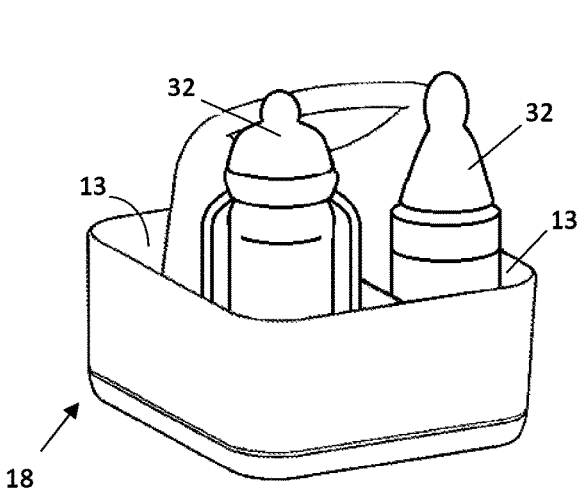
FIGS. 9A-9D illustrate four exemplary bottle carriers depicting containment of several different sizes and types of beverage containers.
Figure 9B:
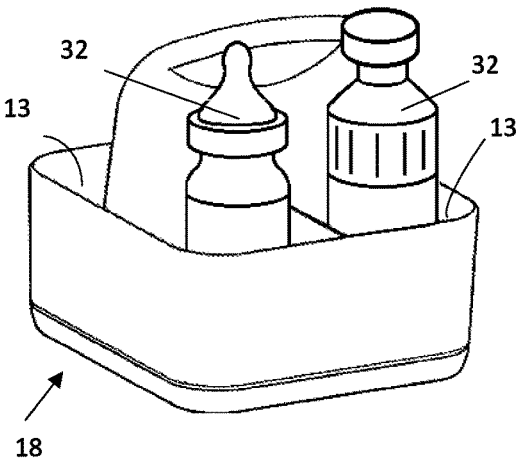
Figure 9C:
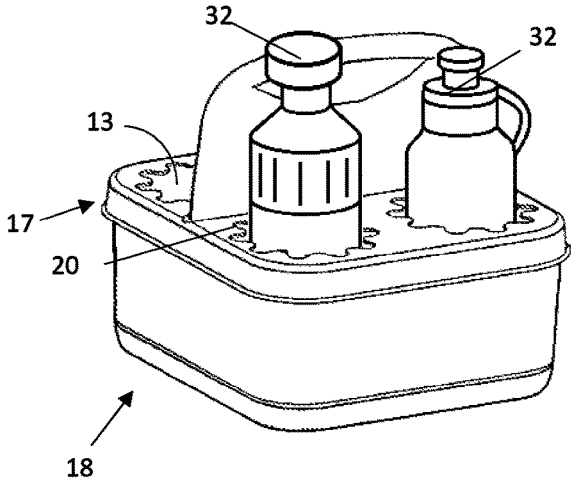
Figure 9D:
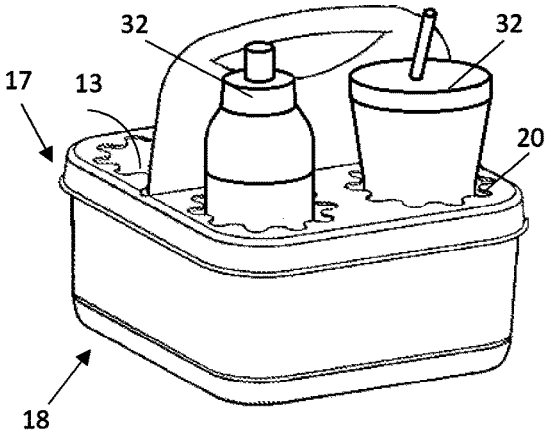

FIGS. 9A-9D illustrate four exemplary bottle carriers depicting containment of several different sizes and types of beverage containers. FIGS. 9A and 9B demonstrate a carrier 10 without a detachable cover where the beverage containers 32 are still stable within the cavities 13. FIGS. 9C and 9D demonstrate beverage containers 32 housed in the carrier 10 with the cover 17 on and the cover grips 20 pushing the sides of the beverages to keep them upright.

Method of Use

Exemplary steps in the method of use of carrier 10 with the cover 17 comprise: 1) providing the carrier base 18 as disclosed herein; 2) extending the base handle 12 through the cover slit 22; 3) securing the cover sidewall 16 securely to the base front 15F, back 15B, right 15R and left 15L sidewalls (e.g. snapping the threads 48 of the lid to the sidewalls 15); 4) inserting a drink container 32 into at least one of the base cavities 13 that comprise substantially square bottoms; 5) inserting a user's hand through handle 12 cutout 11, and lifting and transporting the beverage carrier 10 with one or more drink containers; and 6) removing the drink container from the carrier 10 by sliding out of the cutout 21.

The diameter of the beverage container can vary in the present invention due to the grips 20. Some beverage containers 32 are wide enough to bend the grips 20; and some containers 32 are too thin in diameter to deform grips 20, but still have the grips uniformly make contact with the bottle's perimeter to hold it stable during transport. In an embodiment with wide diameter bottles and/or long grips (e.g. FIG. 11), each of the radially concavity flexible grips 20 may be bent downward at about 45-90 degrees after insertion of a bottle into a respective opening, whereby the flexible grips prevent the bottles from moving. In another embodiment (e.g. FIG. 3) with thinner bottles or shorter grips, the flexible grips are strong enough to hold the bottle in position while not bending inward if the bottle is jostled during transport.

Materials and Method of Manufacture

Base 18 is manufactured as a one-piece unit using a mold, thus producing the base 18 without any seams, i.e. seamless at the partitions or walls 14, or joining the vertical side walls 15 to the flat bottom 25. It may also be formed with a cutout 11 for the handle, or with perforations to mark where to remove material to create the cutout after removing the base from the mold.

Likewise, the detachable cover 17 is formed as a one piece mold with performed grips 20 and openings 21, or with perforations from a user to remove the material to form the grips and circular openings after removing the cover from the mold.

In an embodiment, both the cover 17 and base 18 are made of a flexible rubber-like material, such as 100% silicone, or a silicone with plastic ribs. As a result, the carrier 10 is re-useable, and may be cleaned manually or in a dishwasher.

Material may be affixed to the outer surface of the carrier, such as for aesthetics or to display a logo or trademark. In the figures herein, a horizontal thin rib of material 27 is affixed to base 18 for cosmetic purposes only.

CONCLUSION

The example systems, methods, and acts described in the embodiments presented previously are illustrative, and, in alternative embodiments, certain acts can be performed in a different order, in parallel with one another, omitted entirely, and/or combined between different example embodiments, and/or certain additional acts can be performed, without departing from the scope and spirit of various embodiments. Accordingly, such alternative embodiments are included in the inventions described herein.

Although specific embodiments have been described above in detail, the description is merely for purposes of illustration. It should be appreciated, therefore, that many aspects described above are not intended as required or essential elements unless explicitly stated otherwise. Modifications of, and equivalent components or acts corresponding to, the disclosed aspects of the example embodiments, in addition to those described above, can be made by a person of ordinary skill in the art, having the benefit of the present disclosure, without departing from the spirit and scope of embodiments defined in the following claims, the scope of which is to be accorded the broadest interpretation so as to encompass such modifications and equivalent structures.

The transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

Or, the technology illustratively described herein suitably may be practiced in the absence of any element(s) not specifically disclosed herein. Thus, for example, in each instance herein any of the terms "comprising," "consisting essentially of," and "consisting of" may be replaced with either of the other two terms. The terms and expressions which have been employed are used as terms of description and not of limitation, and use of such terms and expressions do not exclude any equivalents of the features shown and described or portions thereof, and various modifications are possible within the scope of the technology claimed. The term "a" or "an" can refer to one of or a plurality of the elements it modifies (e.g., "a reagent" can mean one or more reagents) unless it is contextually clear either one of the elements or more than one of the elements is described. The term "about" as used herein refers to a value within 10% of the underlying parameter (i.e., plus or minus 5%), and use of the term "about" at the beginning of a string of values modifies each of the values (i.e., "about 1, 2 and 3" refers to about 1, about 2 and about 3). Further, when a listing of values is described herein (e.g., about 50%, 60%, 70%, 80%, 85% or 86%) the listing includes all intermediate and fractional values thereof (e.g., 54%, 85.4%). Thus, it should be understood that although the present technology has been specifically disclosed by representative embodiments and optional features, modification and variation of the concepts herein disclosed may be resorted to by those skilled in the art, and such modifications and variations are considered within the scope of this technology.

As used herein, the term "substantially" refers to approximately the same shape as stated.

While several embodiments of the disclosure have been described, it is not intended that the disclosure be limited thereto, as it is intended that the disclosure be as broad in scope as the art will allow and that the specification be read likewise. Therefore, the above description should not be construed as limiting, but merely as exemplifications of embodiments.

Trademarks: the product names used in this document are for identification purposes only; and are the property of their respective owners.

What is claimed is:

1. A beverage carrier (10), comprising:

a) a base (18) comprising, i. a horizontal flat bottom (25) connected to a seamless vertical sidewall (15), comprising a front, back, right and left seamless sidewall, to form a substantially square or rectangular shaped container with seamless curved ends joining the vertical sidewall, and able to hold a plurality of drink containers;

ii. at least one vertical partition (14) extending perpendicularly between the front to the back vertical sidewalls;

iii. a base handle (12) extending from the flat bottom through a detachable cover (17), and positioned in the middle of the right and left vertical sidewall; and iv. a plurality of substantially rectangular shaped cavities (13) able to hold one drink container per cavity, wherein the cavities are created by the vertical partitions (14), the handle (12), and the vertical sidewalls;

v. wherein the base is a one-piece unit seamless at the horizontal flat bottom (25), the vertical sidewall (15), and the at least one vertical partition (14);

b) a detachable cover (17) comprising, i. a horizontal flat sheet (28) with a plurality of substantially circular cutouts (21) with a plurality of radially concavity shaped flexible grips (20), each cutout aligned with one cavity (13) and able to grip and secure one drink container without jostling;

ii. a cover side wall (16) extending vertically downward from the horizontal flat sheet, and able to secure the detachable cover to the base (18) via said cover sidewall (16) further comprising a resilient material made of silicone: ribs, threads or fixtures that are able to grip the detachable cover (17) to the base vertical sidewall (15);

iii. a horizontal slit (22) for inserting the base handle (12); and c) wherein said carrier is made of machine washable, re-useable, durable material comprising about 90 to about 100 percent silicone, and/or silicone ribs.

2. The beverage carrier of claim 1, wherein said base handle further comprises a top cutout (11) sized to be able to insert a user's hand to lift and transport the carrier.

3. The beverage container of claim 1, wherein the plurality of radially concavity shaped flexible grips (20) are substantially round ended with a length (36) of about 0.25 inches, or with a substantially pointed end with a length (40) of about 0.80 inches.

4. The beverage carrier of claim 1, wherein the detachable cover horizontal slit (22) extends from a middle of a cover right side wall to a middle of cover left side wall (16R,L), said slit sized to enable the base handle to extend vertically through.

5. The beverage carrier of claim 1, wherein said base is able to be manufactured as one-piece, seamless unit from a mold of 100% silicone material.

6. The beverage carrier of claim 1, wherein said beverage carrier comprises four cavities formed from one base vertical partition (14), each cavity able to hold a drink container of the same type or a different type.

7. The beverage carrier of claim 1, wherein said beverage carrier comprises six cavities formed from two base equally spaced vertical partitions (14), each cavity able to hold a drink container of the same type or a different type.

8. A method of use of a beverage carrier, comprising the steps of:

1) providing a beverage carrier (10), comprising:

a) a base (18) comprising, i. a horizontal flat bottom (25) connected to a seamless vertical sidewall (15), comprising a front, back, right and left seamless sidewall, to form a substantially square or rectangular shaped container with seamless curved ends joining the vertical sidewall, and able to hold a plurality of drink containers;

ii. at least one vertical partition (14) extending perpendicularly between the front to the back vertical sidewalls;

iii. a base handle (12) extending from the flat bottom through a detachable cover (17), and positioned in the middle of the right and left vertical sidewall; and iv. a plurality of substantially rectangular shaped cavities (13) able to hold one drink container per cavity, wherein the cavities are created by the vertical partitions (14), the handle (12), and the vertical sidewalls;

v. wherein the base is a one-piece unit seamless at the horizontal flat bottom (25), the vertical sidewall (15), and the at least one vertical partition (14);

b) a detachable cover (17) comprising, i. a horizontal flat sheet (28) with a plurality of substantially circular cutouts (21) with a plurality of radially concavity shaped flexible grips (20), each cutout aligned with one cavity (13) and able to grip and secure one drink container without jostling;

ii. a cover sidewall (16) extending vertically downward from the horizontal flat sheet, and able to secure the detachable cover to the base (18) via said cover sidewall (16) further comprising a resilient material made of silicone: ribs, threads, or fixtures able to grip the detachable cover (17) to the base vertical sidewall (15);

iii. a horizontal cover slit (22) for inserting the base handle (12);

c) wherein said carrier is made of machine washable, re-useable, durable material comprising about 90 to about 100 percent silicone, and/or silicone ribs;

2) Extending the base handle through the cover horizontal slit;

3) Securing the cover sidewall (16) to the base front, rear, right and left sidewalls;

3) Inserting a drink container into at least one of the base cavities;

4) Inserting a user's hand through said base handle and lifting and securely transporting the beverage carrier with one or more drink containers; and 6) removing the one or more drink containers from the beverage carrier by sliding out of the cutout.

9. The method of claim 8, wherein said base handle further comprises a top cutout (11) sized to be able to insert a user's hand to lift and transport the carrier.

10. The method of claim 8, wherein the plurality of radially concavity shaped flexible grips (20) are substantially round ended with a length (36) of about 0.25 inches, or with a substantially pointed end with a length (40) of about 0.80 inches.

11. The method of claim 8, wherein the detachable cover horizontal slit (22) extends from a middle of a cover right side wall to a middle of cover left side wall (16R,L), said slit sized to enable the base handle to extend vertically through.

12. The method of claim 8, wherein said base is able to be manufactured as one-piece, seamless unit from a mold of 100% silicone material.

13. The method of claim 8, wherein said beverage carrier comprises four cavities formed from one base vertical partition (14), each cavity able to hold a drink container of the same type or a different type.

14. The method of claim 8, wherein said beverage carrier comprises six cavities formed from two base equally spaced vertical partitions (14), each cavity able to hold a drinking container of the same type or a different type.

* * * * *